US005203528A

United States Patent [19]

Oke

[11] Patent Number: 5,203,528

[45] Date of Patent: Apr. 20, 1993

[54] FURNITURE LEG WITH HIDDEN GLIDE

[76] Inventor: George V. Oke, 5645 B. General Washington Dr., Alexandria, Va. 22312

[21] Appl. No.: 834,385

[22] Filed: Feb. 12, 1992

[51] Int. Cl.[5] ..... F16M 11/24

[52] U.S. Cl. ..... 248/188.4; 108/156; 248/188.9

[58] Field of Search ..... 248/188.8, 188.9, 188, 248/188.4; 108/157, 156; 403/405.1, 205; 16/19

[56] References Cited

U.S. PATENT DOCUMENTS

| | | | |
|---|---|---|---|
| D. 36,281 | 4/1903 | Orcutt . | |
| D. 186,896 | 12/1959 | Monroe | D33/14 |
| D. 190,332 | 5/1961 | Jakobsen | D33/14 |
| D. 212,125 | 8/1968 | Barry | D54/1 |
| 1,839,593 | 1/1932 | Rice . | |
| 1,849,835 | 3/1932 | Jantzen | 248/188.9 |
| 2,295,911 | 9/1942 | Page | 16/19 |
| 2,520,810 | 8/1950 | Ohlsson | 108/156 |
| 2,744,804 | 5/1956 | Reineman | 248/188.8 |
| 2,783,112 | 2/1957 | Slater | 108/156 |
| 2,852,221 | 9/1958 | Steiner | 248/188 |
| 3,261,584 | 7/1966 | Miller | 108/156 X |
| 3,989,212 | 11/1976 | Jennings | 248/188.9 |
| 4,327,461 | 5/1982 | Wisniewski | 16/42 |
| 4,549,711 | 10/1985 | Giltnane | 403/205 X |

FOREIGN PATENT DOCUMENTS

| | | | |
|---|---|---|---|
| 31522 | 12/1960 | Finland | 248/188.8 |

*Primary Examiner*—J. Franklin Foss

*Attorney, Agent, or Firm*—Shlesinger Arkwright & Garvey

[57] ABSTRACT

The furniture support assembly is generally a furniture leg having a fastening portion at the top thereof for connecting the leg to an article of furniture such as a table or a chair. The fastening structure is a horizontally extending plate having a plurality of holes therein for receiving fasteners. At the foot of the leg is a glide receiving opening in the bottom thereof which is normally hidden from view due to the recess in the foot as well as the angled sides of the foot portion. The location of the glide and the design of the foot portion prevents the glide from detracting from the aesthetic design of the furniture leg.

7 Claims, 1 Drawing Sheet

FURNITURE LEG WITH HIDDEN GLIDE

FIELD OF THE INVENTION

This invention relates to furniture legs having glides extending beneath the feet thereof for providing adjustability of the length of leg as well as for preventing floor damage.

BACKGROUND OF THE INVENTION

Glides have been used for many years in the furniture industry and are attached to the underside of the furniture legs and feet to allow easy sliding of the furniture piece across floors as well as to prevent damage to the furniture leg, particularly in the case of wooden furniture. Glides are generally made of plastic such as nylon or can also be made of metal. In either case, the glides are generally very slick to prevent marring of floors and carpets.

Since glides are generally of a different color and material than that of the article of furniture, glides tend to detract from the appearance of a finely shaped furniture leg. Heretofore, glides have always been a visible feature at the base of the leg due to the fact that the furniture is first constructed and then the glide is tacked or joined to the base of the furniture foot. The glides are generally obtained from a mass manufacturer and are usually standard in shape, but the size is varied according to size and weight of the furniture piece. The glides are not manufactured with any specific style, of furniture in mind, but solely for functionality. Therefore, the glides add no value to the carefully sculpted appearance of fine quality furniture.

In view of the foregoing, it can be seen, that there is a need for a new furniture foot design which eliminates the unsightliness of the attached glide by eliminating the glide from view.

OBJECTS AND SUMMARY OF THE INVENTION

Of the primary object of the invention is to provide a new functional and aesthetic chair leg design.

Another object of the invention is to provide a chair leg design having a foot having a recess formed in the base thereof to facilitate insertion of the furniture glide.

Still another object of the invention is to provide a foot structure having angled side walls so that the top of the foot has a larger perimeter than the bottom so as to said in concealing the base of the foot from view.

Still another object of the invention is to provide a sidewall extending around the interior cavity of the foot wherein the sidewall has a sufficient width to prevent viewing of the glide from above the foot.

Yet another object of the invention is to provide an attachment portion at the top of the furniture leg to enable the furniture leg to be securely fastened to the underside as a support surface such as a chair seat or table.

Yet another object of the invention is to provide a fastening portion having a horizontally extending section having a plurality of holes therein for receiving fasteners and seats about the holes for receiving fastener heads.

In summary, therefore, the invention is a furniture leg having a fastening portion at one end formed by a plate having a plurality of holes therein for receiving fasteners. The plate is offset laterally from the leg and foot. The foot includes a first elevated portion having a perimeter and a second portion below the elevated portion having a smaller perimeter. The foot includes a recess in the base thereof for receiving a glide. The sidewalls of the foot extend around a major portion of the glide so that the glide is hidden when the foot portion is viewed from above.

DETAILED DESCRIPTION OF THE INVENTION

Figure 1:
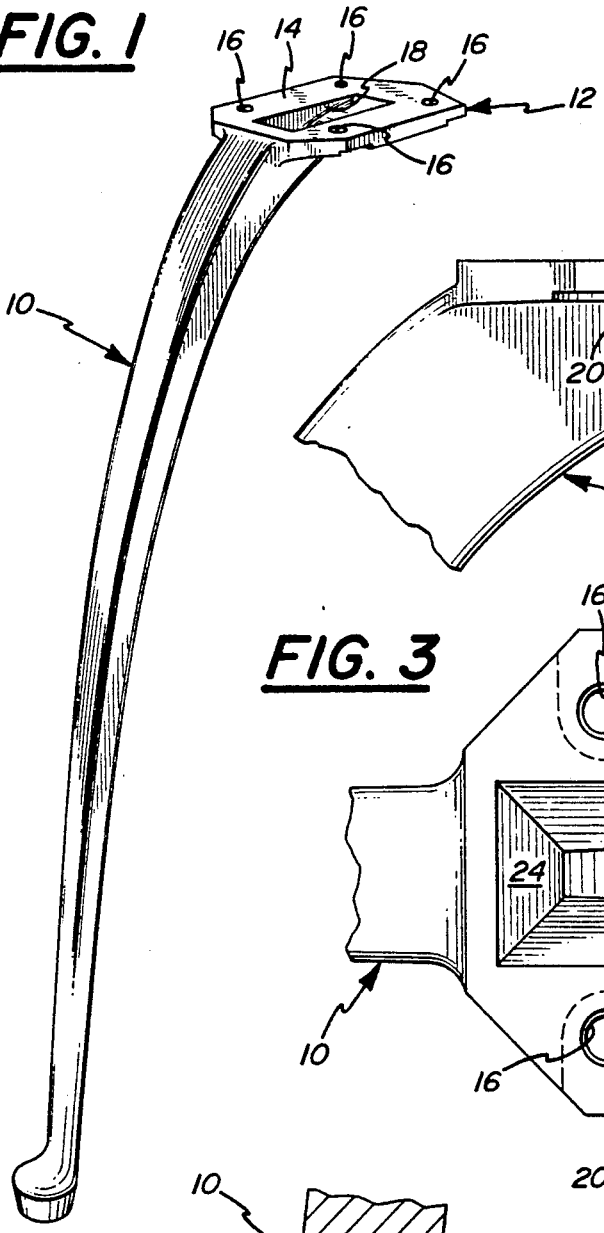
FIG. 1, is an elevational view of the furniture leg.

A furniture leg 10 is shown in FIG. 1. The furniture leg 10, in the preferred embodiment, is similar to a cabriole leg design having a fastening portion 12 for connecting the leg 10 to a support surface (not shown) such as a seat or table. The fastening portion 12 includes a flat section 14 extending generally horizontally and having a plurality of holes 16 therein. A recessed area 18 may also be placed in the top of the flap surface 14 which can engage with a corresponding detent (not shown) of a table top or chair seat.

Figure 2:
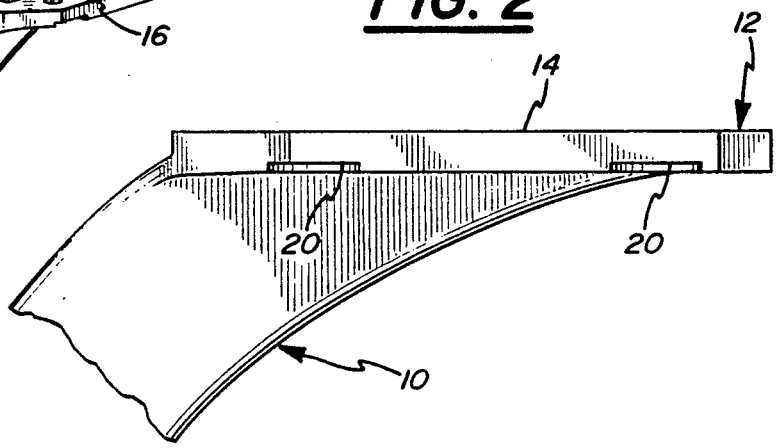
FIG. 2 is an enlarged side view of the fastening portion of the furniture leg of FIG. 1.
Figure 3:
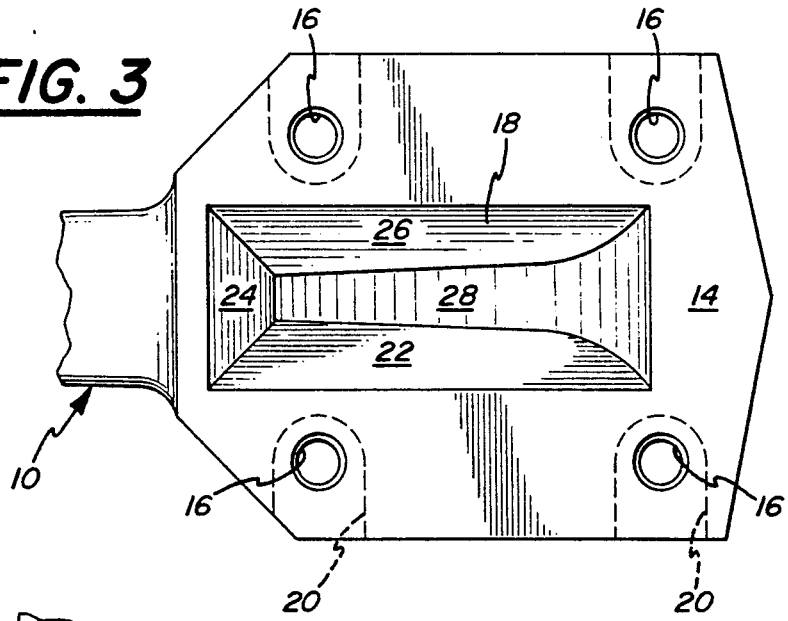
FIG. 3, is a top partial view of the fastening portion of the furniture leg of FIG. 1.

As shown in FIGS. 2 and 3, the fastening portion 12 extends from the leg portion 10 and is laterally offset therefrom.

As shown in FIGS. 2 and 3, fastener recesses 20 are formed on the underside of the flat surface 14 so that the heads (not shown) of fasteners received in the holes 16 can seat.

In FIG. 3, the broad flat surface 14 surrounds the recessed area 18 and the angled descending sides 22, 24, 26, and 28.

Figure 4:
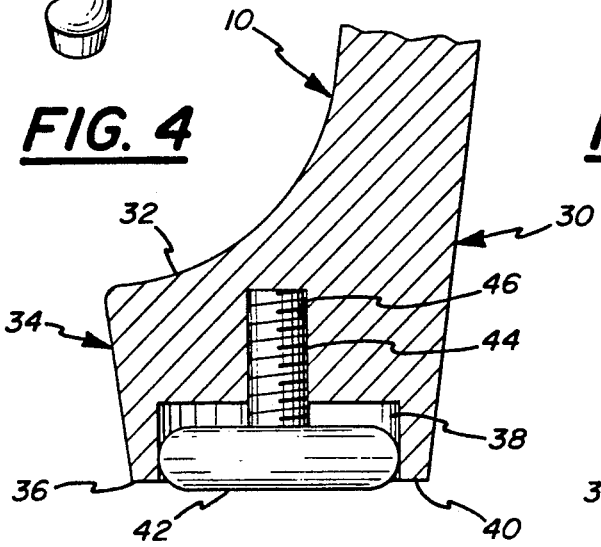
FIG. 4 is a sectional view of the foot portion of the furniture leg of FIG. 1 showing the recessed area and the glide located therein; and, FIG. 5 is a bottom view of the foot portion of FIG. 4 showing the glide within the recessed area.
Figure 5:
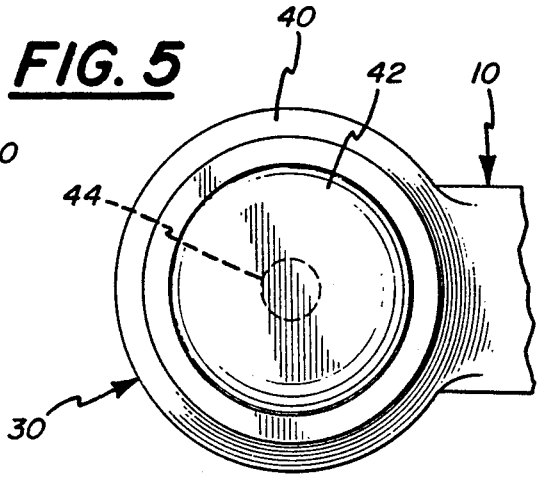

The leg 10 has generally rounded corners and descends in an outwardly curving path to finish in a foot portion 30 as shown in FIG. 1. The foot portion is shown in detail in section in FIG. 4 and includes a top portion 32 extending horizontally outwardly from leg 10. The foot portion includes, preferably, an angled side wall 34 which extends downwardly from top 32 to the narrower bottom edge 36. Within the foot portion 30 is recess 38 extending upwardly from the bottom wall 40.

A glide 42 is preferably located within the recess 38. The glide 42 includes a threaded section 44 which it extends into a threaded opening 46 within the foot 30. The threaded portion 44 allows adjustability between the glide 42 and the foot 30. However, glides 42 can be manufactured to predetermined specifications to eliminate any need for adjustability. In such a case the glide could merely be glued or tacked into place inside the recess 38.

For the glide 42 to operate, it must extend outwardly from recess 38. The distance can vary depending on the circumference of the wall 34. A distance of about between 1/32 and ⅛th inches is generally sufficient.

The bottom 40 should be thick enough to prevent observation of the glide 42 when the viewer is standing up or sitting down, i.e. viewing along a line of sight beginning at a location above the top 32 of the foot portion 30. The incline of the wall 34 additionally aids in keeping the glide 42 hidden from view and thereby prevents the detracting appearance of the glide from interfering with the aesthetic appearance of the sculpted furniture leg.

In use, the leg will be joined to the underside of a chair seat or table top by inserting fasteners (not shown) such as bolts or screws through recesses 20 and into holes 16 so that the fasteners can join with the chair seat or table top. The chair leg 10 will generally extend outwardly either from the rear or the front of the chair or table so that the leg if viewable from above.

The foot portion will be clearly viewable, but the glide 42 will not. The angling of the wall 34 as well as the thickness of the bottom wall 40 will prevent observation of the glide 42 when the chair or table is used in its usual way. The glide 42 will not detract from the overall appearance of the sculpted leg.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A furniture leg assembly for supporting a chair seat or table, said assembly comprising:

a) a leg portion formed of one-piece construction;

b) said leg portion having a top end forming a substantially horizontally extending support surface;

c) said leg portion having an intermediate section extending accurately downwardly and laterally from said support surface;

d) said leg portion including a laterally extending foot;

e) said foot having a first portion having a first perimeter and a second portion having a second perimeter wherein said first portion is elevated above said second portion and said first perimeter is larger than said second perimeter; and, f) said foot includes a tubular downwardly opening recess for receiving a circular glide.

2. The furniture leg assembly as e forth in claim 1, wherein:

a) said support surface includes a plurality of holes for accepting threaded fasteners therethrough.

3. The furniture leg assembly as set forth in claim 2, wherein:

a) said support surface includes recessed seats about each of said holes.

4. The furniture leg assembly as set forth in claim 1, wherein:

a) said foot includes a side wall surface located between said first portion and said second portion forming a frustoconical surface.

5. A foot assembly for a furniture leg and having a normally hidden glide, said foot assembly comprising:

a) a foot portion extending laterally below the leg for supporting the leg;

b) said foot portion having a top wall, a side wall and a bottom wall;

c) said side wall forming a frustoconical surface having a larger circumference at said top end and a smaller circumference at said bottom end;

d) said bottom end forming a ring about a recessed area; and, e) wherein a glide is located in said recessed area and extends slightly therefrom to form a bearing surface which is hidden when said foot assembly is viewed from above.

6. The foot assembly as set forth in claim 5, wherein:

a) said glide is vertically adjustable.

7. The foot assembly as set forth in claim 5, wherein:

a) said foot assembly includes a leg unitarily connected thereto.

* * * * *